US007108776B2

(12) United States Patent
Sakaki

(10) Patent No.: US 7,108,776 B2
(45) Date of Patent: Sep. 19, 2006

(54) PLATING APPARATUS AND PLATING METHOD

(75) Inventor: Yasuhiko Sakaki, Hiratsuka (JP)

(73) Assignee: Electroplating Engineers of Japan Limited, Tokyo (JP)

( * ) Notice: Subject to any disclaimer, the term of this patent is extended or adjusted under 35 U.S.C. 154(b) by 437 days.

(21) Appl. No.: 10/268,001

(22) Filed: Oct. 8, 2002

(65) Prior Publication Data

US 2003/0070932 A1 Apr. 17, 2003

(30) Foreign Application Priority Data

Oct. 11, 2001 (JP) ..... P2001-313845

(51) Int. Cl.
*C25D 11/32* (2006.01)
*C25D 7/12* (2006.01)
*C25D 17/00* (2006.01)

(52) U.S. Cl. ..... 205/157; 204/212; 204/213; 204/214

(58) Field of Classification Search ..... 204/212–214, 204/198–199, 221–222, 143, 193; 205/143, 205/137, 145, 157
See application file for complete search history.

(56) References Cited

U.S. PATENT DOCUMENTS 5,853,559 A * 12/1998 Tamaki et al. ..... 205/157
5,932,077 A * 8/1999 Reynolds ..... 204/224 R
6,332,963 B1 * 12/2001 Sakaki et al. ..... 204/266
6,454,918 B1 * 9/2002 Sakaki ..... 204/252
6,610,182 B1 * 8/2003 Sakaki ..... 204/275.1
2003/0057098 A1 * 3/2003 Sendai et al. ..... 205/143

OTHER PUBLICATIONS

Shinoura Osamu, et al., "Plating Method and Plating Device", Patent Abstracts of Japan, Publ. Num. 09-041198, Date of Publication Feb. 10, 1997.
Kondo Akihiro, "Treating Device For Plating or Washing", Patent Abstracts of Japan, Publ. Num. 09-078300, Date of Publication Mar. 25, 1997.
Sasabe Kenichi, et al., "Plating Device and Plating Method", Patent Abstracts of Japan, Publ. Num. 2001-049495, Date of Publication Feb. 20, 2001.

* cited by examiner

*Primary Examiner*—Nam Nguyen
*Assistant Examiner*—Luan V. Van
(74) *Attorney, Agent, or Firm*—Roberts & Roberts, LLP

(57) ABSTRACT

In the invention, there is provided a plating treatment technique which permits uniform plating treatment and easy replacement of articles to be plated without the effect of bubbles in a plating solution by improving wet plating apparatuses of the contact type to thereby solve problems such as the removal of bubbles in a plating solution and the removal of an adhering plating solution. Provided is a plating apparatus having a plating tank, which comprises: an opening which has a solution seal to prevent a plating solution from leaking when an article to be plated is placed on the opening; a solution-supply portion which supplies the plating solution; a solution-discharge portion which discharges the plating solution; and an anode which is opposed to the article to be plated that is placed, wherein the plating tank has rotational means for rotating the plating tank itself.

25 Claims, 4 Drawing Sheets

PLATING APPARATUS AND PLATING METHOD

BACKGROUND OF THE INVENTION

1. Field of the Invention

The present invention relates to a plating treatment technique for performing plating while removing bubbles present in a plating solution and, more particularly, to a plating apparatus and a plating method which are suitable for an article to be plated whose plating property is greatly affected when bubbles in a plating solution adhere to the surface of the article.

2. Description of the Related Art

Wet plating treatment has thitherto been adopted in various kinds of plated articles. In wet plating treatment, it is necessary only that the basic construction be such that an article to be plated is brought into contact with a plating solution and a plating current is given. Therefore, wet plating treatment is used in a huge variety of articles to be plated and various configurations of apparatus for wet plating have been proposed.

Wet plating apparatuses are broadly divided into the following two types. One is called "the immersion type" and plating treatment is performed by immersing an article to be plated in a plating solution. The other is "the contact type," in which an article to be plated is not immersed in a plating solution and instead only a surface requiring plating treatment is brought into contact with a plating solution in order to ensure that only the surface in contact with the plating solution is subjected to plating treatment.

Apparatuses of these two types of "the immersion type" and "the contact type" have their advantages and disadvantages. Therefore, an optimum type of plating apparatus is selected in consideration of various conditions, such as the shape and kind of an article to be plated, the surface of an article to be plated which is subjected to plating treatment, and the type of plating solution.

For example, in the case of a plate-like article to be plated such as a semiconductor wafer and a printed circuit board, a plating apparatus of "the contact type" may sometimes be adopted in consideration of the fact that only one surface is subjected to plating treatment and that automatic plating treatment is performed by continuously replacing articles of the same size to be plated. This is because this plating apparatus of "the contact type" permits easy replacement of articles to be plated and is suitable for a case where the surface of a plate-like article to be plated is only one surface.

In this plating apparatus of "the contact type," it is necessary only that the construction be such that the target plating surface of an article to be plated can be brought into contact with a plating solution. For this reason, there are two types of this plating apparatus. In one type, an article to be plated is placed on a top opening of a plating tank with the target plating surface kept facing downward and plating treatment is performed by supplying a plating solution to the interior of the plating tank. This type can be called "the top placement type." In the other type, an article to be plated is arranged at the bottom of a plating tank with the target plating surface kept facing upward and plating treatment is performed by supplying a plating solution to the top of the article to be plated. The latter type can be called "the bottom arrangement type."

In the "top placement type," it is necessary only that an article to be plated be placed on a top opening of a plating tank. Therefore, the replacement of articles to be plated is very easy and hence suitable for the automation of plating treatment. The "top placement type" is frequently adopted in mass plating treatment of plate-like articles to be plated, such as wafers. In this "top placement type," however, a plating solution is present below an article to be plated. Therefore, this inevitably leads to the occurrence of the phenomenon that bubbles in the plating solution, i.e., bubbles of air generated from an anode during plating treatment, bubbles of air entrapped in the plating solution, etc. ascend toward the target plating surface. For this reason, measures to remove bubbles are required in order to perform uniform plating treatment.

On the other hand, in the case of "the bottom arrangement type," a plating solution is present above an article to be plated. Therefore, bubbles in the plating solution has no effect on the article to be plated and, therefore, uniform plating treatment is possible without measures to remove bubbles. However, in this plating apparatus of "the bottom arrangement type," the target plating surface of an article to be plated faces upward. Therefore, even after removal of the plating solution, a large amount of plating solution adheres to the surface and hence plating solution removal work becomes necessary after plating treatment. Furthermore, replacement of articles to be plated cannot be easily carried out in comparison with "top placement type."

Thus, the conventional wet plating apparatuses of "the contact type" had problems in the removal of bubbles from a plating solution, the removal of an adhering plating solution, the replacement of articles to be plated, etc. and could not be said to be wholly satisfactory as plating apparatuses that can simultaneously meet the requirements for uniform plating treatment and easy plating treatment.

SUMMARY OF THE INVENTION

Accordingly, it is the object of the invention to provide a plating treatment technique which permits uniform plating treatment and easy replacement of articles to be plated without the effect of bubbles in a plating solution by improving wet plating apparatuses differentiated as "the contact type" to thereby solve problems such as the removal of bubbles in a plating solution and the removal of an adhering plating solution.

In order to solve the above-described problems, in the invention there is provided a plating apparatus having a plating tank, which comprises: an opening which has a solution seal to prevent a plating solution from leaking when an article to be plated is placed; a solution-supply portion which supplies the plating solution; a solution-discharge portion which discharges the plating solution; and an anode which is opposed to the article to be plated that is placed, wherein the plating tank has rotational means for rotating the plating tank itself.

Because the plating apparatus of the invention is provided with rotational means for rotating the plating tank itself, an article to be plated is placed on the opening of the plating tank in the same condition as with "the top placement type" and after that, the plating tank is rotated, whereby the positional relationship between the article to be plated and the plating solution is changed as with "the bottom arrangement type," enabling plating treatment to be performed by ensuring that bubbles in the plating solution is prevented from having an effect on the object plating surface of the article to be plated. And after plating treatment, it is possible to replace articles to be placed in such a condition that the plated article placed on the opening of the plating tank is on the top side and the plating tank is on the bottom side, that is, by rotating the plating tank to the same condition as with "the top placement type."

It is necessary only that the rotational means provided in the plating tank in the invention have a mechanism that can freely change the positional relationship between the article to be plated and the plating solution, i.e., the posture of the article to be plated, which has been placed. For example, it is necessary only that the rotational means be able to rotate the plating tank itself around a prescribed axis. More concretely, the rotational means may be a side wall that constitutes the plating tank and in the side wall, an axis of rotation is provided in a position corresponding to the center in the longitudinal section of the plating tank and driving means such as a stepping motor is connected to this axis of rotation. The plating tank can be rotated with such a simple structure. Furthermore, it is also possible to adopt what is called robot arm type rotational means capable of holding the plating tank and rotating the plating tank in a held condition, a rotational means which is provided with a base on which the bottom surface of the plating tank is fixed and this base can perform a reverse motion, etc.

There is no limitation to the rotational motion of the plating tank itself in the plating apparatus of the invention, and the rotational angle and frequency of rotations during plating treatment can be appropriately selected. For the rotation of the plating tank, for example, the plating tank may be rotated through 90 degrees so that an article to be plated, which is placed on the opening, is brought into a standing condition or the plating tank may be rotated through 180 degrees so that the article to be plated is brought into a reverse condition, i.e., the condition as with "the bottom arrangement type." Furthermore, the rotational motion may be performed repeatedly during plating treatment, and the plating tank may be rotated in a continuous rotational motion. In short, it is necessary only that by rotating the plating tank itself, bubbles in the plating solution be prevented from exerting an adverse influence on the target plating surface of an article, which is subjected to plating treatment.

According to this plating apparatus of the invention, it is no longer necessary to take the measures to remove bubbles hitherto carried out in "the top placement type," for example, the removal of bubbles by increasing the supply flow rate of plating solution thereby to discharge a large amount of plating solution and the elimination of the effect of bubbles on an article to be plated by arranging an anode bag, a diaphragm, etc. within the plating tank. That is, plating treatment is possible without the effect of bubbles in the plating solution even when the supply flow rate of plating solution is small and even when special measures to remove bubbles are not taken. Furthermore, because plating treatment is carried out in a condition not affected by bubbles as with "the bottom arrangement type" during plating treatment and the condition in the case of "the top placement type" can be recovered after the completion of the treatment, the replacement of articles to be plated can be easily carried out and the adherence of the plating solution to the articles to be plated can be reduced.

And in the plating apparatus of the invention, it is preferred that a bubble-vent hole be provided in the plating tank. When a bubble-vent hole is provided in the plating tank, the plating tank is rotated in such a manner that this bubble-vent hole assumes a top position, and plating treatment is carried out in this state, bubbles in the plating solution ascend toward the bubble-vent hole and it becomes possible to efficiently remove the bubbles from the plating solution.

Furthermore, in the plating apparatus related to the invention, it is preferred that stirring means for forcedly stirring a plating solution supplied to the interior of the plating tank be provided. When such stirring means of plating solution is provided, it is possible to sufficiently supply plating metal ions to the target plating surface of an article to be plated. Therefore, the plating apparatus of the invention is very suitable in a case where high-current-density, high-speed plating treatment is performed.

There is no special limitation in structure etc. on the stirring means of the invention so long as the stirring means can forcedly stir a plating solution supplied to the plating tank. For example, stirring means having a plurality of impellers may be provided in the plating tank to perform a rotational motion near an article to be plated or a pump mechanism capable of injecting a plating solution may be provided in the plating tank to inject the plating solution toward an article to be plated. In short, it is necessary only that as a result of forced stirring of a plating solution supplied to the interior of the plating tank, a flow condition of the plating solution which promotes the supply of plating metal ions to the target plating surface of an article to be plated be capable of being realized.

In addition, it is preferred that in the plating apparatus related to the invention, part of the wall of the plating tank can be opened and closed. When part of the wall of the plating tank can be opened and closed, by rotating the plating tank, the tank wall portion which can be opened and closed is caused to assume a top position. By opening the tank wall portion in that position, it is possible to easily carry out maintenance within the plating tank, such as anode replacement, even when all plating solution is not discharged to outside the plating tank. It is especially preferred in terms of practical use that this tank wall which can be opened and closed be provided on the side of the tank wall where the anode is provided. The anode disposed in a position opposite to an article to be plated needs to be replaced after a certain plating treatment when the anode is a soluble one. Even when the anode is an insoluble one, maintenance such as replacement and cleaning is required because black films etc. adhere to the anode surface after a long period of plating treatment. For this reason, when the tank wall on the side where this anode is disposed can be opened and closed, by rotating the plating tank thereby to cause this tank wall which can be opened and closed to assume a top position, it is possible to easily carry out maintenance work such as anode replacement by opening the tank wall.

DETAILED DESCRIPTION OF THE PREFERRED EMBODIMENTS

Figure 1:
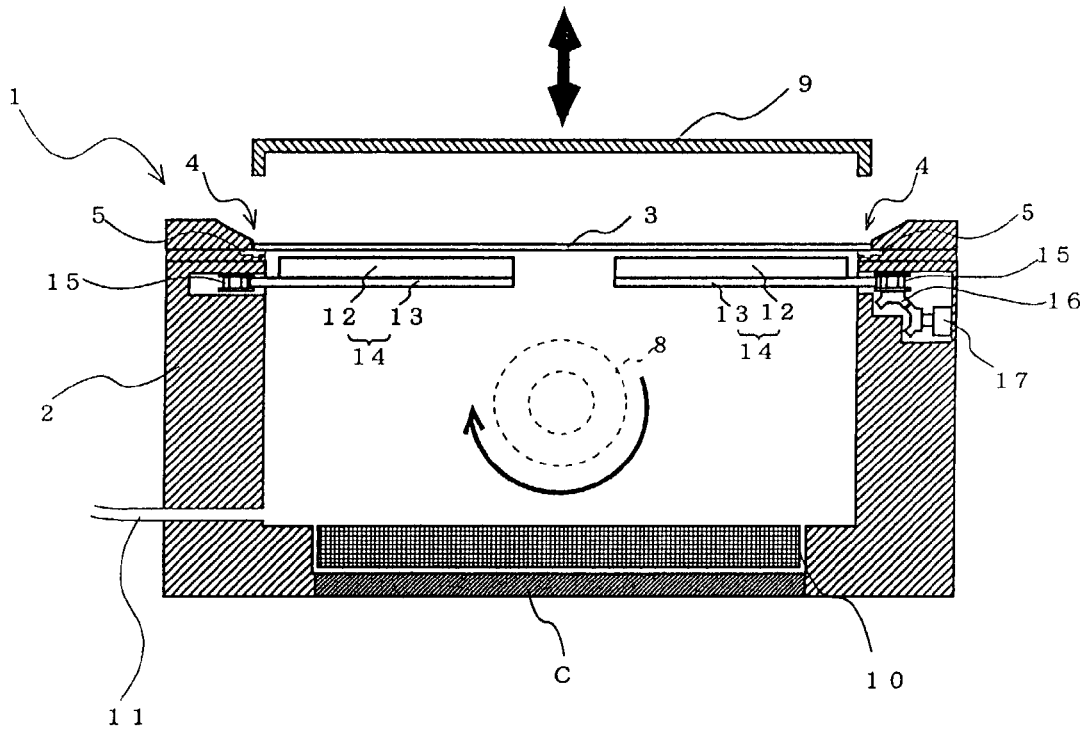
FIG. 1 is a schematic sectional view of a rotary plating apparatus in an embodiment of the invention.
Figure 2:
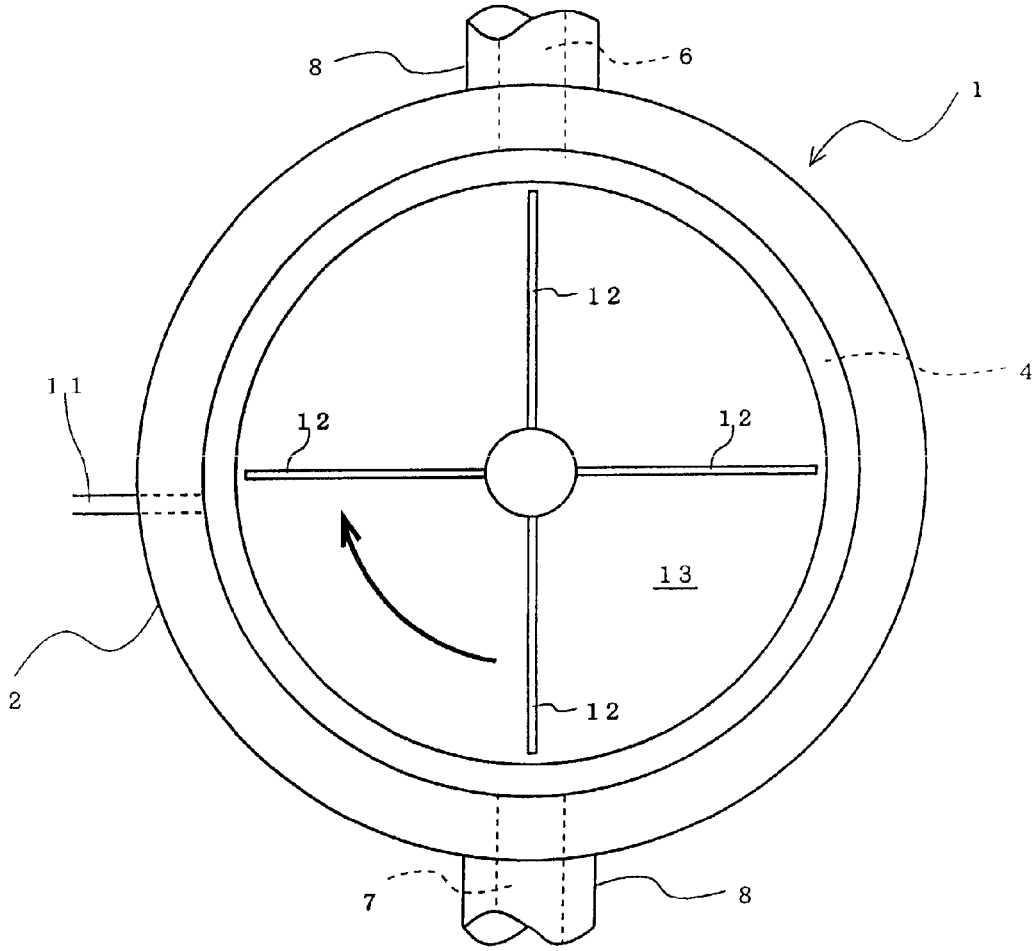
FIG. 2 is a schematic top view of the rotary plating apparatus in the embodiment of the invention.

A preferred embodiment of a plating apparatus related to the invention will be described below. FIG. 1 and FIG. 2 show, respectively, a schematic sectional view and a schematic top view of a rotary plating apparatus in this embodiment. The rotary plating apparatus I in this embodiment has a plating tank 2 in the form of a bottomed cylinder, and this plating tank 2 has an opening 4 to place a wafer 3 thereon, which is provided with a seal 5 for preventing a plating solution from leaking. And rotary shafts 8, which simultaneously serve as a plating solution supply pipe 6 and a plating solution discharge pipe 7 and permit the rotation of the plating tank 2 in the direction indicated by an arrow in FIG. 1, are provided in a circumferential wall of the plating tank 2. The rotary shafts 8 are connected to a motor for rotation, which is not shown.

Above the opening 4 of the plating tank 2 is provided depressing means 9 capable of moving vertically to fix a placed wafer 3 to the opening by depressing the periphery of the wafer. Also, within the plating tank 2, there is disposed an anode electrode 10 opposite to the wafer 3 placed on the opening 4. The wafer 3 is in contact with a cathode electrode (not shown) disposed on the opening 4, and this cathode electrode and the anode electrode 10 are connected to a power source for plating treatment, which is not shown. Furthermore, part of the circumferential wall is provided with a bubble-vent hole 11 to discharge bubbles in a plating solution to outside the plating tank 2. Moreover, a tank cover C capable of freely opening and closing (in this embodiment, the bottom wall of the plating tank 2 at which the anode electrode is disposed) is provided on the tank wall of the interior of the plating tank 2 where the anode electrode 10 is disposed.

Near the wafer 3 placed on the opening 4 within the plating tank 2, there is disposed a solution stirring plate 14, which comprises a disk 13 on which a plurality of stirring vanes 12 are installed in a standing manner. The peripheral edge side of the disk 13 has the shape of a gear. A plurality of pulleys 15 are arranged in the plating tank 2, and by meshing the pulleys 15 with the peripheral edge of the disk 13, the solution stirring plate 14 is supported in the plating tank 2 so as to be parallel to the target plating surface of the wafer 3. As shown in FIG. 2, this solution stirring plate 14 comprises the disk 13 on which the four stirring vanes 12 are radially installed in a standing manner, and the solution stirring plate 14 can rotate in the direction indicated by the arrow by means of a bevel gear 16 and a drive motor 17, which are connected to one of the pulleys 15. Incidentally, in the schematic top view of FIG. 2, the illustrations of the depressing means 9, wafer 3 and driving mechanism of the solution stirring plate, such as the pulley 12, which are shown in FIG. 1, are omitted to make clear the construction of the interior of the plating tank 2.

Next, an example of a procedure for performing plating treatment by using the rotary plating apparatus 1 shown in FIGS. 1 and 2 will be described below. First, the wafer 3 is placed on the opening 4 of the plating tank 2, and the opening 4 of the plating tank 2 is sealed in a liquid-tight manner by depressing the wafer 3 by using the depressing means 9. Then, a plating solution is supplied from the solution supply pipe 6 to the interior of the plating tank 2, and the interior of the plating tank 2 is filled with the plating solution by adjusting the discharge amount from the solution discharge pipe 7 by using a discharge valve, which is not shown. As a result, the plating solution in the plating tank 2 and the target plating surface of the wafer 3 are brought into a contact condition.

Figure 3:
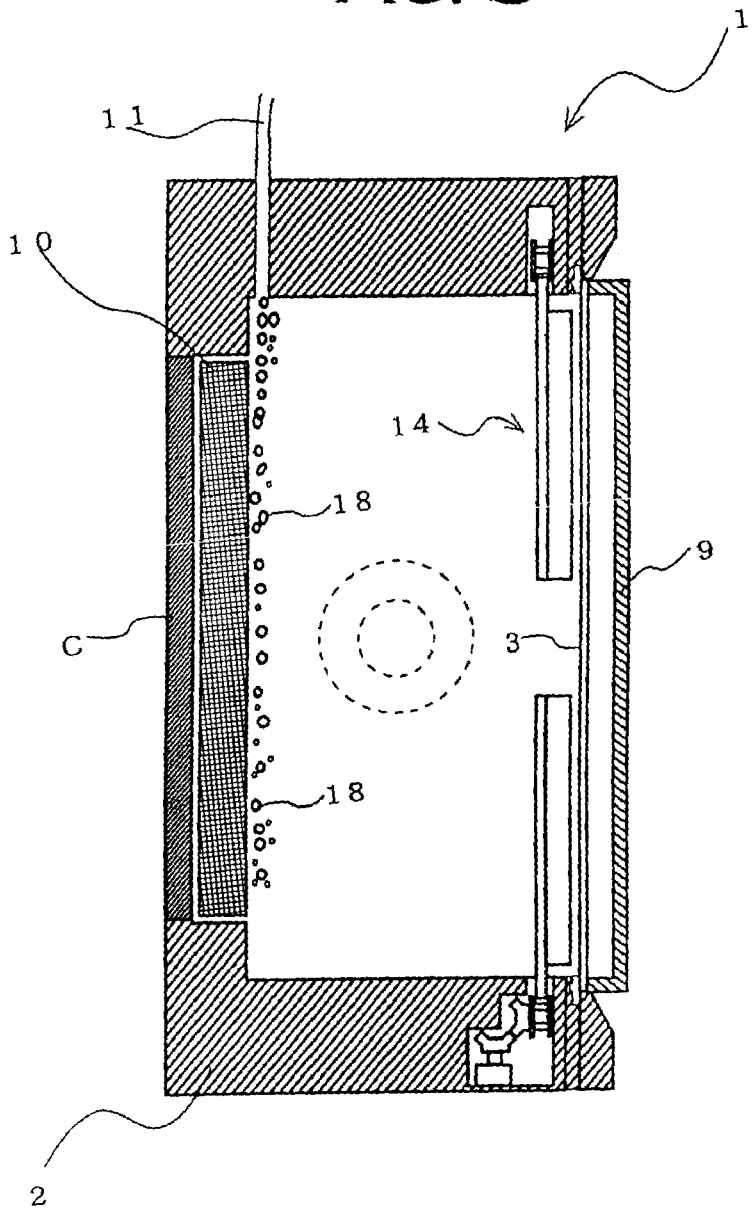
FIG. 3 is a schematic sectional view when a plating tank of the rotary plating apparatus in the embodiment of the invention is rotated.

After that, as shown in FIG. 3, the wafer 3 is brought into a standing condition by rotating the plating tank through a prescribed angle by means of the rotary shaft 8 so that the bubble-vent hole 11 provided in the plating tank 2 assumes a top position. And plating treatment is performed by supplying a prescribed plating current to the wafer 3 by using a power source for plating treatment, which is not shown. Because the opening of the plating tank 2 is kept in a condition sealed by the wafer 3 in a liquid-tight manner during this plating treatment, the plating solution does not leak from this opening.

During plating treatment, as shown in FIG. 3, bubbles 18 of air generated from the anode electrode 10, of air entrapped in the plating solution supplied by circulation, etc. ascend toward the bubble-vent hole 11 and do not reach the surface of the wafer 3 to be subjected to plating treatment. Furthermore, by rotating the solution stirring plate 14, the plating solution near the target plating surface of the wafer 3 is forcedly stirred, whereby the supply of plating metal ions is promoted.

After the completion of prescribed plating treatment, by rotating the plating tank 2, as shown in FIG. 1, the plating tank 2 is returned to a position where the wafer 3 becomes horizontal and the wafer 3 for which plating treatment has been completed is removed from the opening 4.

"Although this embodiment is described in an example where the bubble-vent hole 11 is provided in one place, the bubble-vent hole 11 may be provided in a plurality of places. Furthermore, in a case where no bubble-vent hole is provided, by rotating the plating tank beforehand so that the solution discharge pipe 7 assumes a top position, bubbles in the plating solution ascend toward the solution discharge pipe and can be discharged to outside the plating tank together with the plating solution which is being discharged. Furthermore, also for the rotational angle of the plating tank, the case of a rotation through about 90 degrees is shown in FIG. 3. However, the plating apparatus becomes "the bottom arrangement type" when the plating tank is rotated through 180 degrees and the adverse effect of bubbles on the target plating surface of an article to be plated can be almost completely eliminated. That is, a rotational angle that enables efficient bubble removal to be performed can be freely selected. "

Figure 4:
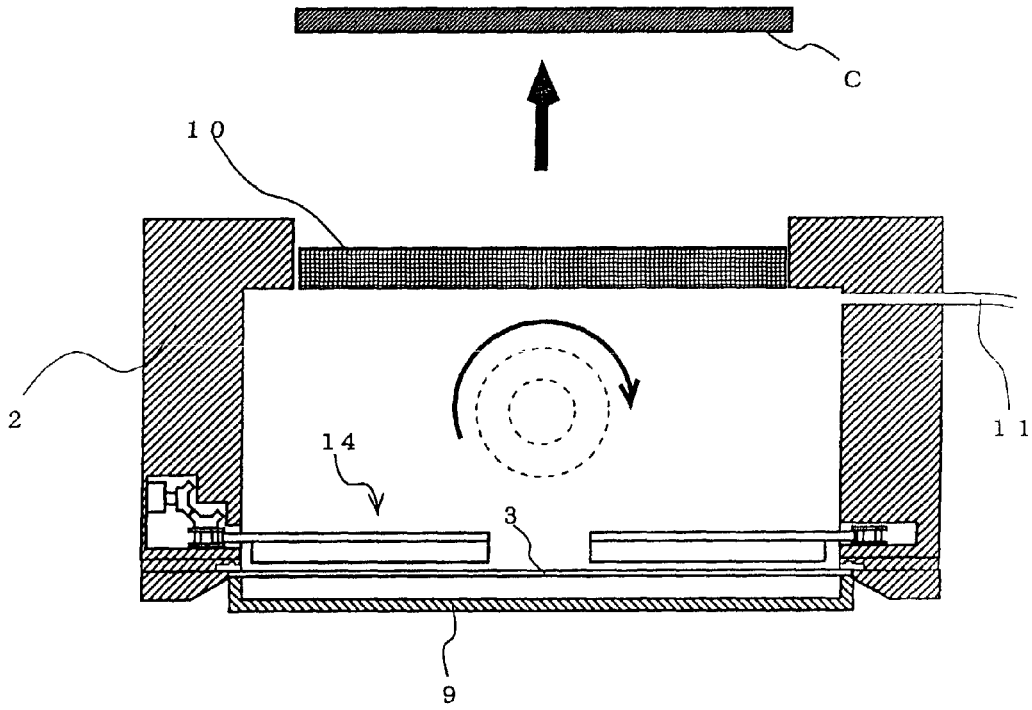
FIG. 4 is a schematic sectional view when the plating tank of the rotary plating apparatus in the embodiment of the invention is rotated through 180 degrees.

Furthermore, in the rotary plating apparatus described in this example, as shown in FIG. 4, the replacement of the anode electrode 10 and the maintenance of the interior of the plating tank 2 can be carried out by rotating the plating tank through 180 degrees with the wafer 3 kept placed so that the tank cover C assumes a top position and by removing the tank cover C in this condition.

"By using the rotary plating apparatus described in this embodiment, a silicon wafer (diameter: 8 inches, thickness: 0.5 mm) coated with copper as a seed metal film to a thickness of 0.1 μm was subjected to plating treatment for forming copper bumps (about 60000 in number) having a diameter of 125 μm and a height of 100 μm. Copper bump formation was carried out by electrolytic plating treatment of copper by using a copper sulfate-based plating solution. As a result, copper bumps formed on the surface of a wafer were completely free from poor bump shapes due to the effect of bubbles and defects such as voids. Furthermore, copper bumps of uniform shape were formed on the whole surface of the target plating surface of the wafer. "

The replacement of the wafer after plating treatment could be easily performed and the amount of plating solution adhering to the wafer surface subjected to plating treatment was small in comparison with conventional plating apparatuses of the "bottom arrangement type," with the result that the wafer could be transferred to the succeeding process after simple cleaning treatment. Furthermore, plating treatment could be carried out to form copper bumps which are free from defects and have a uniform shape even when the copper bumps were formed at a high current density of 10 $A/dm^2$.

According to the plating apparatus of the invention, it becomes possible to perform plating treatment without an adverse effect of bubbles in a plating solution on plating treatment and, at the same time, it becomes possible to easily replace a plated article placed on the opening of the plating tank after plating treatment.

What is claimed is:

1. A plating apparatus having a plating tank, said plating tank comprising:

an opening which has a solution seal to prevent a plating solution from leaking when an article to be plated is placed on the opening;

a solution-supply portion which supplies the plating solution;

a solution-discharge portion which discharges the plating solution; and an anode which is opposed to the article to be plated that has been placed, wherein said plating tank is provided with rotational means for rotating the plating tank around an axis, wherein an axis of rotation is present in a position corresponding to the center in longitudinal section of the plating tank; and a driving means is connected to the axis of rotation.

2. The plating apparatus according to claim 1, wherein a bubble-vent hole to discharge bubbles in a plating solution is provided in said plating tank.

3. The plating apparatus according to claim 1, wherein said plating tank comprises stirring means for forcedly stirring a supplied plating solution.

4. The plating apparatus according to claim 1, wherein said plating tank is configured in such a manner that part of a wall of the plating tank is openable and closable.

5. A plating method comprising the steps of:

placing an article to be plated on an opening of a plating tank, whereby the opening is sealed by the article to be plated in a liquid-tight manner;

supplying a plating solution and filling an interior of the plating tank with the plating solution, whereby the plating solution and the article to be plated are brought into contact with each other; and performing plating treatment on a surface of the article to be plated through using an anode provided in the interior of the plating tank and the article to be plated, wherein plating treatment is performed through rotating the plating tank around an axis via a driving means connected to an axis of rotation, which axis of rotation is present in a position corresponding to the center in longitudinal section of the plating tank, and whereby the posture of the article to be plated which is placed on the opening is changed.

6. The plating method according to claim 5, wherein a bubble-vent hole is provided in the plating tank and plating treatment is performed through rotating the plating tank so that bubbles in the plating solution ascend and gather in the bubble-vent hole.

7. The plating method according to claim 5, wherein plating treatment is performed while forcedly stirring the plating solution supplied to the plating tank through using stirring means provided in the plating tank.

8. The plating apparatus according to claim 2, wherein said plating tank comprises stirring means for forcedly stirring a supplied plating solution.

9. The plating apparatus according to claim 2, wherein said plating tank is configured in such a manner that part of a wall of the plating tank is openable and closable.

10. The plating apparatus according to claim 3, wherein said plating tank is configured in such a manner that part of a wall of the plating tank is openable and closable.

11. The plating apparatus according to claim 8, wherein said plating tank is configured in such a manner that part of a wall of the plating tank is openable and closable.

12. The plating apparatus of claim 1 wherein said plating tank further comprises a removable cover.

13. The plating apparatus of claim 1 wherein said rotational means comprises a rotatable shaft.

14. The plating apparatus of claim 3 wherein said stirring means comprises a stirring plate which plate comprises a disk having a plurality of stirring vanes.

15. The plating apparatus of claim 8 wherein said stirring means comprises a stirring plate which plate comprises a disk having a plurality of stirring vanes.

16. The plating apparatus of claim 3 wherein said stirring means is supported in the plating tank by pulleys which are attached to a wall of said tank.

17. The plating apparatus of claim 16 wherein said stirring means is rotated by a motor attached to the pulleys.

18. The plating apparatus of claim 1 further comprising a depressing means capable of fixing a wafer to the opening by depressing the periphery of the wafer and sealing the wafer to the opening.

19. A plating apparatus comprising (a) a plating tank defined by a wall and a floor, said plating tank having an opening and a solution seal around the opening to prevent a plating solution from leaking when an article to be plated is placed on the seal and the opening;

(b) a solution-supply portion which supplies a plating solution into the tank;

(c) a solution-discharge portion which discharges said plating solution from the tank;

(d) a tank rotator which is capable of rotating the plating tank around an axis, wherein an axis of rotation is present in a position corresponding to the center in longitudinal section of the plating tank;

(e) a driving means is connected to the axis of rotation;

(f) an anode, which anode is positioned adjacent to said floor and opposite to said opening;

(g) a bubble-vent hole through said wall; and (h) a stirring means within the tank for stirring a plating solution within the tank.

20. The plating apparatus of claim 19 wherein said stirring means comprises a stirring plate which plate comprises a disk having a plurality of stirring vanes.

21. The plating apparatus of claim 19 wherein said stirring means is supported in the plating tank by pulleys which are attached to the wall of said tank.

22. The plating apparatus of claim 21 wherein said stirring means is rotated by a motor attached to the pulleys.

23. The plating apparatus of claim 19 further comprising a depressing means capable of fixing an article to be plated to the seal and the opening.

24. The plating apparatus of claim 19 wherein said plating tank further comprises a removable cover.

25. The plating method according to claim 6, wherein plating treatment is performed while forcedly stirring the plating solution supplied to the plating tank through using stirring means provided in the plating tank.

* * * * *